United States Patent [19]

Martin

[11] 4,197,915

[45] Apr. 15, 1980

[54] SELF-RIGHTING THROWN OR ROLLED SPHERICAL FIRE EXTINGUISHER

[76] Inventor: Eoudis Martin, 812 NE. 17, Oklahoma City, Okla. 73105

[21] Appl. No.: 947,282

[22] Filed: Sep. 29, 1978

[51] Int. Cl.[2] ..... A62C 13/46

[52] U.S. Cl. ..... 169/72; 169/89; 222/402.14; 222/469; 251/89; 251/115

[58] Field of Search ..... 169/30, 36, 71, 72, 169/74, 89; 239/337, 562; 220/69, 70; 251/89, 113, 115; 222/402.13, 402.14, 402.15, 469, 470, 509, 518, 402.1, 402.25, 485

[56] References Cited

U.S. PATENT DOCUMENTS

| | | | |
|---|---|---|---|
| 2,359,573 | 10/1944 | MacKay | 169/36 |
| 2,601,767 | 7/1952 | Wall | 220/69 X |
| 2,941,418 | 6/1960 | Esser | 251/115 X |
| 3,092,183 | 6/1963 | Guise et al. | 169/89 X |
| 3,785,569 | 1/1974 | Helmrich | 169/36 X |
| 4,096,966 | 6/1978 | Korshak | 220/69 |

*Primary Examiner*—David A. Scherbel
*Assistant Examiner*—Fred A. Silverberg
*Attorney, Agent, or Firm*—Robert K. Rhea

[57] ABSTRACT

A substantially spherical hollow body is filled with a fire extinguishing chemical under greater than atmospheric pressure. The top of the body is provided with a normally closed exhaust valve biased open by a handle. The handle is also used to throw the extinguisher into a fire.

1 Claim, 5 Drawing Figures

SELF-RIGHTING THROWN OR ROLLED SPHERICAL FIRE EXTINGUISHER

BACKGROUND OF THE INVENTION

1. Field of the Invention

The present invention relates to fire extinguishers and more particularly to a ball-shaped fire extinguisher which may be thrown toward the flame source.

Many fires can be quickly brought under control by applying a fire retardant fluid or chemical to the source of the fire, however, this is frequently not possible when using manually operated fire extinguishers on account of intense heat. It is, therefore, desirable that a fire extinguisher be provided which is capable of being thrown into a fire or rolled along a surface from a remote point to the midst of a fire.

2. Description of the Prior Art

Fire extinguishers capable of being thrown into a fire have usually comprised a frangible body containing an explosive charge which is ruptured by the heat of the flames igniting the explosive after the extinguisher has been thrown into the fire, such as disclosed by U.S. Pat. Nos. 2,515,832 and 3,980,139. In a fire extinguisher, such as disclosed by these patents, the extinguisher must be accurately thrown into the source of the fire with a time lapse necessary for the heat to ignite an explosive charge to rupture the container.

This invention provides a substantially spherical body which may be thrown or rolled into a fire wherein the fire extinguishing chemical is being ejected from the extinguisher from the time it is thrown until exhausted of such chemical with the body having the added feature that it contains a weight normally causing the body to come to rest in an upright position within the fire so that the chemical is horizontally ejected into the fire in radial directions from its position.

SUMMARY OF THE INVENTION

A hollow spherical body is truncated at diametrically opposite positions to define a flat bottom parallel with a flat top. A weight, such as a layer of lead, is secured within the body in overlying relation with respect to its bottom for inducing the body to come to rest on its bottom after being thrown. The top of the body is provided with a normally closed exhaust valve communicating with the interior of the body with the valve being biased to an open position by a handle secured to the exhaust valve. The body is filled with a fire extinguishing chemical, under greater than atmospheric pressure, through a filler valve secured to its top. A pressure gauge, mounted on the top of the body, visually indicates when the body has been charged with a fire extinguishing chemical.

The principal objects of this invention are to provide a fire extinguishing self uprighting device which may be manually carried to an existing fire and hurled or rolled to the center thereof to put out the fire at its source wherein the release of chemical from the extinguisher is insured by a positive action manually operated carrying handle biasing the chemical exhaust valve to an open position at the time the extinguisher is thrown into a flame or fire which discharges the contained fire retardant chemical in a generally horizontal plane.

DESCRIPTION OF THE PREFERRED EMBODIMENT

Figure 2:
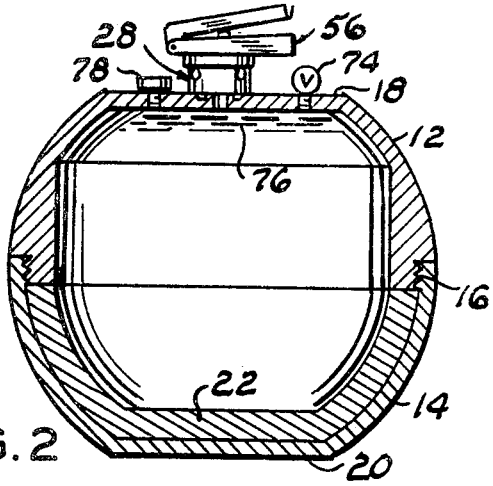
FIG. 2 is a vertical cross sectional view, partially in elevation, taken substantially along the line 2—2, of FIG. 1.
Figure 1:
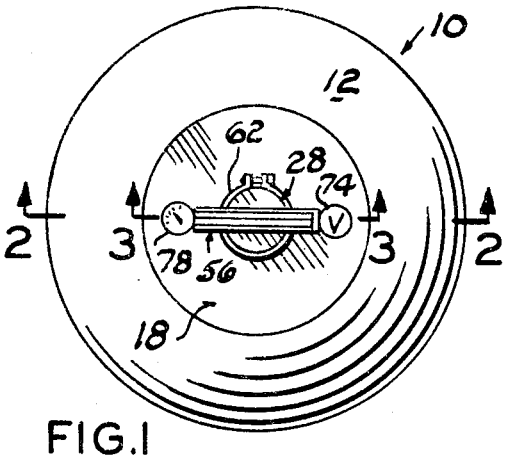
FIG. 1 is a top view of the fire extinguisher.

Like characters of reference designate like parts in those figures of the drawings in which they occur.

In the Drawings:

The reference numeral 10 indicates the fire extinguisher, as a whole, which is substantially spherical. The extinguisher 10 is formed by a diametrically divided hollow body having a truncated hemispherical top portion 12 and a truncated hemispherical bottom portion 14 and having cooperating threads 16 for joining the top portion to the bottom portion and defining a flat top wall 18 parallel with a flat bottom wall 20. The flat bottom 20 normally supports the body in an upright position. The inner wall surface of the bottom portion 14 is lined with a layer of dense metal, such as lead 22, as a weight to bias the body to an upright position after being thrown or rolled into a fire, as presently explained.

The top wall 18 is provided with an exhaust port 24, and further provided with an upstanding externally threaded wall-like ring 26 surrounding the port 24 for receiving an exhaust valve body 30 having a central bore 32 communicating with a counterbored recess 34 in the depending end of the valve body defining a valve body wall 36 threadedly engaged with the ring 26. The valve body 30 is further provided with a tapered valve seat 38 facing toward the exhaust port 24 concentric with respect to the valve bore 32. The valve body is further counterbored, as at 39, adjacent the inward limit of the valve seat 38 and provided with a plurality of radially disposed vents 40 communicating, at their innermost ends, with the counterbore 39 and flaring outwardly at their other ends through the outer wall surface of the valve body. The valve bore 32 and its vents 40 are normally closed by a valve head 42, preferably formed from resilient material, for cooperative engagement with the seat 38 and normally seated by a helical spring 44, nested at one end within a coaxial recess 46 formed in the valve head facing toward the exhaust port 24 and seated at its other end within a recess 48 formed in the extinguisher top wall 18 between the exhaust port 24 and ring 26. A circumferential arcuate portion 49 of the valve head overlaps the depending limit of the valve seat 38 and is nested by a cooperating valve body recess 50 to enhance the tight sealing action of the valve head 42. The valve head 42 is provided with a coaxial stem 51 slidably received by the valve body bore 32 and projecting thereabove a selected distance. The depending end of the stem 51 is provided with a diametrically reduced end portion 52 imbedded within the valve head 42 and has a substantially hemispherical surface 54 formed on its upwardly disposed end.

Handle means 56 is connected with the valve means 28 for carrying the fire extinguisher and biasing the valve means to an open position as presently explained.

Figure 3:
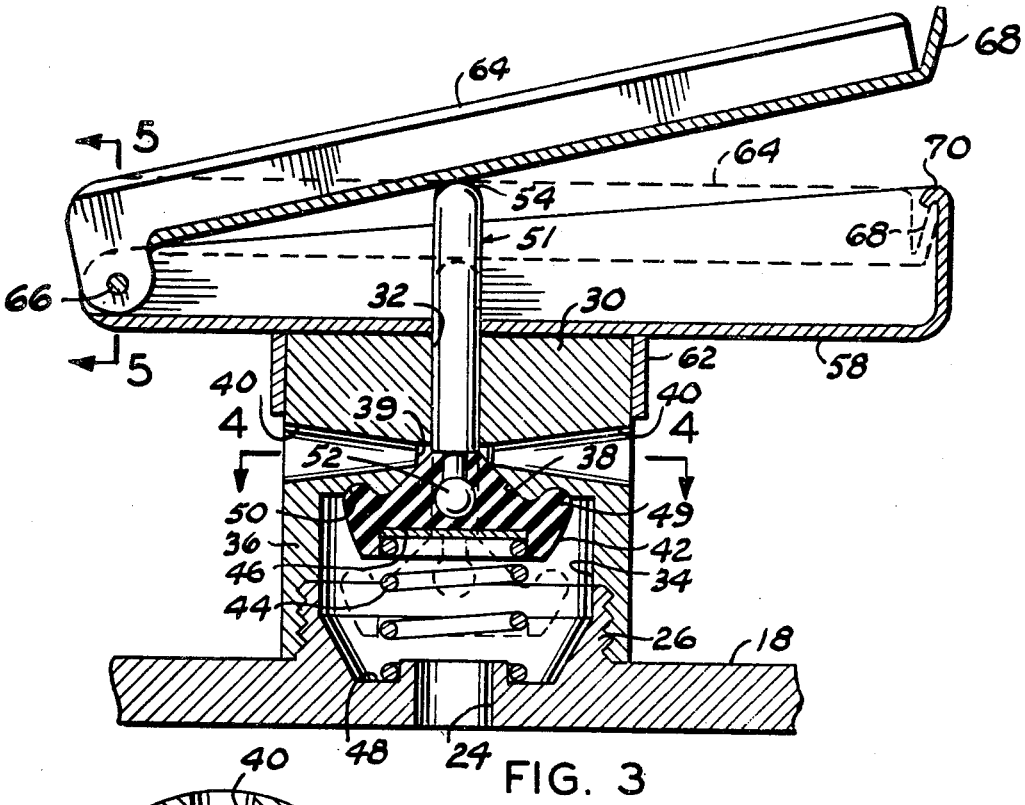
FIG. 3 is a fragmentary vertical cross sectional view, to an enlarged scale, taken substantially along the line 3—3 of FIG. 1.
Figure 4:
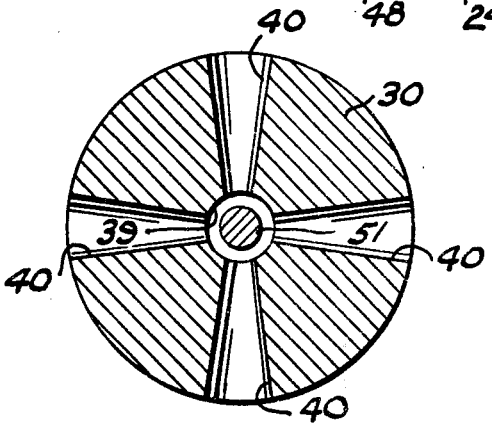
FIG. 4 is a horizontal view taken substantially along the line 4—4 of FIG. 3; and, FIG. 5 is a vertical cross sectional view, to another scale, taken substantially along the line 5—5 of FIG. 3.
Figure 5:
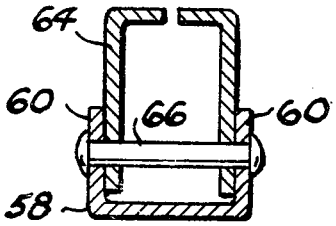

The handle means 56 comprises an elongated fixed position handle 58 substantially channel-shaped in transverse section having the legs 60 thereof disposed upwardly. The bight portion of the fixed handle 58 is provided with an aperture slidably receiving the valve stem 51 and is rigidly secured transversely to the valve body 30 above the position of the vents 40 by a strap clamp 62. The handle means 56 further includes a pivoting handle portion 64 pivotally connected, at one end, by a pin 66 between the legs 60 of one end of the fixed handle 58 for vertical pivoting movement of the pivoting handle about the horizontal axis of the pin 66. The pivoting handle 64 is substantially box-shaped and of slightly less length than the fixed handle 58 and is provided, at its end opposite the pin 66, with an upstanding prong forming a catch 68 for engagement with an inverted J-shaped hook 70 formed on the end portion of the fixed handle 58, opposite the pin 66, when the pivoting handle is manually moved into the fixed handle. An intermediate portion of the depending surface of the pivoting handle 64 overlies the valve stem hemispherical end surface 54. The valve 42 is opened by manually forcing the pivoting handle 64 into the fixed position handle 58 which moves the valve stem 51 downwardly, as viewed in the drawings, against the resilience of the valve spring 44 to lock the handle means 56 in handle collapsed position which unseats the valve head 42 as shown by dotted lines (FIG. 3).

The extinguisher top wall 18 is further provided with a fire retardant, indicated at 76, which is preferably under greater than atmospheric pressure. The top wall 18 is further provided with a pressure gauge 78 for visual indication of the pressure of the fire retardant contained by the extinguisher body.

Operation

In operation, the extinguisher 10 is assembled as described hereinabove and is filled with a fire retardant chemical. The pivoting handle 64 normally remains in its solid line position of FIG. 3 with the mass of the pivoting handle resting on the hemispherical end portion 54 of the valve stem 51 wherein the resilience of the valve spring 44 and pressure of the fire retardant maintains the valve 42 seated and supports the mass of the pivoting handle. In an emergency, when the extinguisher is needed to put out a fire, the extinguisher is carried by the handle means 56 to a point adjacent the fire and the operator manually forces the pivoting handle to its locked dotted line position of FIG. 3 wherein the fire retardant begins exhausting through the exhaust port 24 and the valve vents 40. Simultaneously, with this action the extinguisher is thrown or rolled toward the source of the flames wherein the fire extinguisher normally comes to rest by gravity in an upright position, as shown in FIG. 2, wherein the fire retardant is exhausted horizontally toward the flames, not shown, through the vents 40. The valve means 28 and handle means 56 preferably do not project outwardly of the spherical plane generated by the curved portion of the extinguisher body to enhance the extinguisher rolling action when thrown or rolled into a fire.

Obviously the invention is susceptible to changes or alterations without defeating its practicability. Therefore, I do not wish to be confined to the preferred embodiment shown in the drawings and described herein.

I claim:

1. A portable fire extinguisher, comprising:

a generally spherical hollow body containing a fire retardant under greater than atmospheric pressure and having portions of its periphery truncated to define a top surface surrounding an exhaust port and a bottom surface parallel with the top surface;

a layer of dense material within said hollow body overlying at least the inner surface of said bottom surface for normally biasing said hollow body toward a position of repose with its top surface disposed upwardly;

exhaust valve means normally closing the exhaust port, said exhaust valve means including a centrally bored cylindrical valve body communicating with the exhaust port and connected at one end to said top surface and having a concentric recess formed in its connected end defining a valve seat facing toward the exhaust port, said valve body having a counterbore at the inward limit of the valve seat and having a plurality of radially disposed vents communicating with the counterbore, a valve having a head movable toward and away from the valve seat for opening and closing the valve body bores and having a valve stem slidable within the valve body bores and projecting beyond the end of said valve body opposite its connected end, and, a valve spring interposed between said top surface and said valve head for normally biasing said valve to a closed position; and, handle means secured to the valve means for transporting said hollow body and biasing said valve means open, said handle means including an elongated channel-like fixed handle having its bight portion transversely overlying and rigidly secured intermediate its ends to the end of said valve body opposite its valve seat and having an aperture in its bight portion surrounding an intermediate portion of the outwardly disposed end portion of said valve stem, and, a pivoting handle pivotally connected at one end portion with one end portion of said fixed handle in overlying relation with respect to the outwardly disposed end of said valve stem for pivoting movement toward and away from said fixed handle, said pivoting handle having an outstanding prong formed on its end opposite its pivotally connected end, said fixed handle having an inverted J-shaped hook formed on its end portion opposite its connection with said pivoting handle for locking engagement with said prong.

* * * * *